US006340951B1

(12) United States Patent
Sheen

(10) Patent No.: US 6,340,951 B1
(45) Date of Patent: Jan. 22, 2002

(54) WIDEBAND MICROSTRIP LEAKY-WAVE ANTENNA

(75) Inventor: Jyh-Wen Sheen, Ilan Hsien (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/761,888

(22) Filed: Jan. 17, 2001

(30) Foreign Application Priority Data

Jun. 2, 2000 (TW) ..... 89110771 A

(51) Int. Cl.[7] ..... H01Q 1/38
(52) U.S. Cl. ..... 343/700 MS
(58) Field of Search ..... 343/700 MS, 767, 343/770, 829, 846; H01Q 1/38, 13/10

(56) References Cited

U.S. PATENT DOCUMENTS 5,337,065 A * 8/1994 Bonnet et al. ..... 343/767
5,581,256 A * 12/1996 McEwan ..... 342/27
5,903,239 A * 5/1999 Takahashi et al. ... 343/700 MS
5,943,017 A * 8/1999 Cosenza et al. ..... 343/700 MS
6,081,237 A * 6/2000 Sato et al. ..... 343/713
6,081,728 A * 6/2000 Stein et al. ..... 455/523
6,160,524 A * 12/2000 Wilber ..... 343/787
6,166,693 A * 12/2000 Nalbandian et al. . 343/700 MS

* cited by examiner

*Primary Examiner*—Tho Phan
(74) *Attorney, Agent, or Firm*—Darby & Darby

(57) ABSTRACT

A wideband microstrip leaky-wave antenna comprising a substrate with a cavity, a microstrip line located on a first surface of the substrate and a conductive plate located on a second surface of substrate opposite to the first surface. Using the cavity between the microstrip line and the conductive plate can reduce the effective dielectric constant of the substrate and further increase the bandwidth of the antenna. In addition, the microstrip line also can be located in the cavity. In this case, there is no dielectric material between the microstrip line and the conductive plate.

11 Claims, 6 Drawing Sheets

WIDEBAND MICROSTRIP LEAKY-WAVE ANTENNA

BACKGROUND OF THE INVENTION

1. Field of the Invention

The present invention generally relates to the technique of antennas. More specifically, the present invention relates to microstrip leaky-wave antennas utilized for wideband applications for increasing the operating bandwidth of the antenna and reducing the sensitivity of the direction of the antenna major lobe with respect to the operating frequency.

2. Description of the Prior Art

A leaky-wave antenna is generally utilized for high-frequency applications, especially for millimeter waves. Compared with traditional resonant antennas, the leaky-wave antenna has such advantages as higher manufacturing tolerance, simpler shaping and easier integration with feeding system, etc. In addition to the advantages mentioned above, because a leaky-wave antenna has a characteristic that the direction of the major lobe in the radiation pattern can vary in angle as the change of the operating frequency, it also can be utilized as a frequency-scanning antenna.

In general, there are two kinds of leaky-wave antennas for generating radiated waves. The first one utilizes periodic structure. That is, the energy in this kind of leaky-wave antenna is emitted by structural periodic disturbances that cause spacial harmonics, such as dielectric gratings, metal plate gratings, and slot array on a metal slice. The second one utilizes open waveguides having the same shapes. Energy emission in this kind of leaky-wave antenna is achieved by the way in which the operation frequency of the propagation mode is assigned near to the cut-off region, such as groove waveguides, non-radiative dielectric waveguides and microstrips.

Because the microstrip line is manufactured by metal, its energy loss will much higher than that of leaky-wave antennas manufactured by high-Q(quality) dielectrics. In addition to being widely applied to various high-frequency applications, the microstrip leaky-wave antenna has various advantages, such as simple structures and easily manufacturing. Therefore, it is especially appropriate for the applications of integrated antennas and low-cost commercial antennas, etc.

FIG. 1 (PRIOR ART) is the perspective view of the conventional microstrip leaky-wave antenna. As shown in FIG. 1, microstrip leaky-wave antenna 10 is a strip of metal and placed at one side of dielectric material 20. The other side of dielectric material 20 is connected to a grounded metal plate 30. In addition, the width of microstrip leaky-wave antenna 10 is represented by W, the thickness of dielectric material 20 is represented by h, and the dielectric constant is represented by $\epsilon r$. In general, dielectric constant is about larger than 2. The microstrip leaky-wave antenna should be operated around the cut-off region by utilizing the first higher order mode. Usually, the propagation way pertaining to the higher order modes in microstrips can be divided into four frequency regions as shown in FIG. 2 (PRIOR ART), which shows the relation between the normalized higher-order-mode phase constant (denoted by /Ko) and the normalized attenuation constant (denoted by /Ko) to the frequency (denoted by f). In FIG. 2, the phase constant of the higher order modes in the microstrips is represented by the attenuation constant of higher order modes in the microstrips is represented by, and the wave number in air is represented by Ko. The curve of the normalized higher order mode phase constant /Ko and the curve of the normalized attenuation constant /Ko in FIG. 2 are represented by numerals 1 and 2, respectively. As shown in FIG. 2, there are four regions from high frequency to low frequency.

(I) Bound Mode Region

In this region, the normalized higher order mode phase constant /Ko is larger than 1 and the normalized attenuation constant /Ko is equal to 0. More specifically, the higher order mode phase constant is larger than the phase constant of surface waves on the substrate (represented by s). That is, the energy in this region is bound in microstrip and cannot be emitted.

(II) Surface Wave Region

In this region, the normalized higher order mode phase constant /Ko is between 1 and the normalized phase constant of surface waves on the substrate (i.e., s/Ko). A tiny amount of the attenuation constant is also appeared in this region. Due to the fact that the energy carried by the microstrip leaks in the form of surface waves and cannot be emitted to the air, general antennas cannot utilize this region. Besides, the tiny amount of the attenuation constant represents the energy leakage in the form of surface waves.

(III) Space Wave Region

In this region, the normalized higher order mode phase constant /Ko is lower than 1. It means that the energy can be coupled to be the surface waves and the space waves. Due to the fact that most of the energy is coupled to the air, this region can be used to implement antennas. Besides, the attenuation constant in this region is larger than that in the surface wave region, which means the energy leakage of surface waves and space waves in physics.

(IV) Cut-off Mode Region

In this region, the attenuation constant is larger than the phase constant, which means that the cut-off feature can dominate the operation of the microstrip lines. Therefore, this region cannot be used in the applications of energy emission. Most of the fed signal energy will be reflected. Therefore, it is difficult to design appropriate antenna structures and the energy emission of such antennas is not efficient. Due to the reasons mentioned above, this region is not appropriate for antenna applications.

According to these kinds of microstrip higher order mode regions mentioned above, the microstrip leaky-wave antenna can be appropriately operated in the space wave region, more specifically, by using the first higher order mode operated near the cut-off region. The cut-off frequency of the higher modes of the microstrip can be described in details as follows. The microstrip leaky-wave antenna is different to the closed waveguide. There is no obvious separation between neighboring operation regions like the closed waveguide due to the leaked energy near the cut-off region. In fact, the propagation constant of the closed waveguide has an imaginary part (=j) in the higher frequencies at the separation point, which means that the wave can be propagated. In addition, there is a real number (=) of the propagation constant in the lower frequencies at the separation point, which means the attenuation of the propagated energy. On the contrary, there are no specific cut-off separation points for open microstrip where the higher order mode propagates on. For example, using the cavity model, the cut-off frequency of the microstrip leaky-wave antenna structure shown in FIG. 1 can be defined as:

$$f_c = \frac{c}{2W\sqrt{\varepsilon_r}} \tag{1}$$

Wherein the light speed is represented by c, the width of microstrip 10 is represented by w, and the relative permittivity of dielectric material 20 is represented by r. Next, the frequency bandwidth is described as follows. As described above, the space wave mode is the most appropriate one for antenna applications and the normalized phase constant is between 1 and the cut-off points. Using this relation, the radiation bandwidth can be deduced as:

$$f_c < f < \frac{f_c\sqrt{\varepsilon_r}}{\sqrt{\varepsilon_r - 1}} \tag{2}$$

As mentioned above, the dielectric constant of the substrate is usually larger than 2. The maximum usable bandwidth of the traditional microstrip leaky-wave antennas, according to the frequency bandwidth defined in equation (2), is about 40%. The usable bandwidth in practical applications usually cannot reach even 20% while considering other factors such as the bandwidth of the feeding system, the limitation of the antenna size (length) and the antenna gain etc.

Besides, the characteristic that the direction of major lobe will be varied in angle as the change of the operating frequency can be described by using the equation below. In other words, by the concept of whether phase angle is matched, the angle of the major lobe of the antenna can be roughly determined as the equation below:

$$\theta = \cos^{-1}\frac{\beta}{k_0} \tag{3}$$

The propagation constant can change as the varying operating frequency. According to equation (3), the angle of the major lobe also changes during using the antenna. These kinds of antennas can be utilized for applications of phase array antennas by utilizing the characteristic above. That is, one scanning dimension is controlled by utilizing conventional phase shifters and the other scanning dimension is controlled by utilizing the change of the operating frequency. Therefore, phase shifters originally used in the one-dimensional control mechanism for these phase array antennas can be waived. Utilizing the microstrip leaky-wave antenna to manufacture a phase array antenna is low-cost due to the reduction of the expensive phase shifters. On the other hand, high-gain antennas, or called the point-to-point satellite receiver antennas, can also be manufactured by utilizing the microstrip leaky-wave antenna. However, the shift of the main lobe in this kind of antennas will cause a problem in their application. More specifically, if these antennas are applied to the narrow bandwidth applications, such as around 1% of the bandwidth, the shift of the main lobe is quite small. However, if these antennas are applied to wide-band applications, such as larger than 10% of the bandwidth, the shift amount of the main lobe is huge based on equation (3). It will cause such problems as disturbance or the degradation of the system quality for the point-to-point communication.

According to the reasons mentioned above, the microstrip leaky-wave antenna could be easily applied for some specific applications, but not appropriate for some other applications due to their characteristics. According to equation (2), for example, the bandwidth of the microstrip leaky-wave antenna is narrow, which makes it difficult to be applied for wideband applications. In addition, according to equation (3), the direction of the major lobe is sensitive to the operating frequency, which can facilitate the applications of the array antennas, but is not appropriate for point-to-point communications.

SUMMARY OF THE INVENTION

Therefore, an object of the present invention is to provide a wideband microstrip leaky-wave antenna, which has an increased operating bandwidth and a low sensitivity with respect to the operating frequency.

The present invention achieves the above-indicated objects by providing a first type of the wideband microstrip leaky-wave antenna. It comprises a substrate constituted by at least one dielectric layer and having a cavity, a microstrip line made of conductive material and located on a first surface of the substrate corresponding to a location of the cavity, and a conductive plate made of conductive material and located on a second surface of the substrate opposite to the first surface. This structure can reduce the effective dielectric constant. As described above, when the effective dielectric constant of the substrate is reduced, its corresponding bandwidth will increase.

The present invention discloses a second type of the wideband microstrip leaky-wave antenna. It comprises a substrate constituted by at least one dielectric layer and having a cavity, a microstrip line made of conductive material and located in the cavity of the substrate, for emitting leaky waves, and a conductive plate made of conductive material and located on a surface of the substrate, the dielectric layer of the substrate being excluded from a space between the conductive plate and the microstrip line. Since the space between the microstrip line and the conductive plate does not include the dielectric material and is filled up with the air, the effective dielectric constant is almost 1. When the effective dielectric constant approaches 1, the corresponding bandwidth will increase.

In addition, the present invention also discloses a third type of the wideband microstrip leaky-wave antenna. It comprises a substrate constituted by at least one dielectric layer and a microstrip line made of conductive material and located on a first surface of the substrate, for emitting leaky waves, wherein on a second surface of the substrate opposite to the first surface there is no conductive plate corresponding to the microstrip line. This type of antennas can provide an enlarged bandwidth. In addition, the normalized phase constant $\beta/k_0$ is almost constant within the range of the bandwidth. As described above, the direction of the major lobe emitted by this type of antennas is insensitive to the operating frequency. In addition, the substrate portion in this kind of antennas also can be omitted and, therefore, the microstrip line is surrounded by the air. The energy source can be fed into an end of the microstrip line. This simplified structure also can achieve the object of the present invention.

BRIEF DESCRIPTION OF THE DRAWINGS

The following detailed description, given by way of example and not intended to limit the invention solely to the embodiments described herein, will best be understood in conjunction with the accompanying drawings, in which.

DETAILED DESCRIPTION OF THE INVENTION

First Embodiment

According to equations (1) and (2) described above, when the dielectric constant of the substrate in a microstrip leaky-wave antenna decreases or approach to 1, its bandwidth is also enlarged. The method for increasing the bandwidth adopted by the present invention is to reduce the effective dielectric constant of the substrate. In this embodiment, using a scheme of stuffing an air layer into the substrate that initially contains a dielectric layer can decrease the effective dielectric constant to be close to 1.

Figure 1:
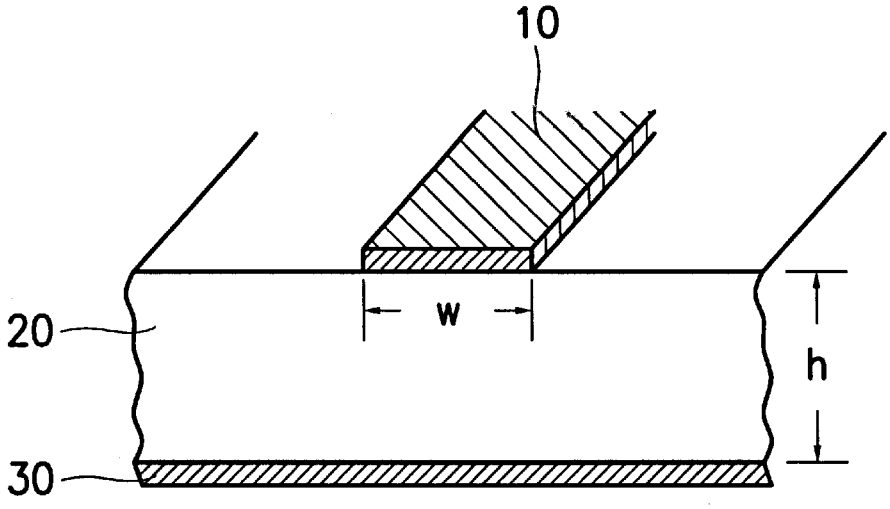
Fig. 1 ( PRIOR ART )
FIG. 1 (PRIOR ART) is a sectional view of the conventional microstrip leaky-wave antenna.
Figure 2:
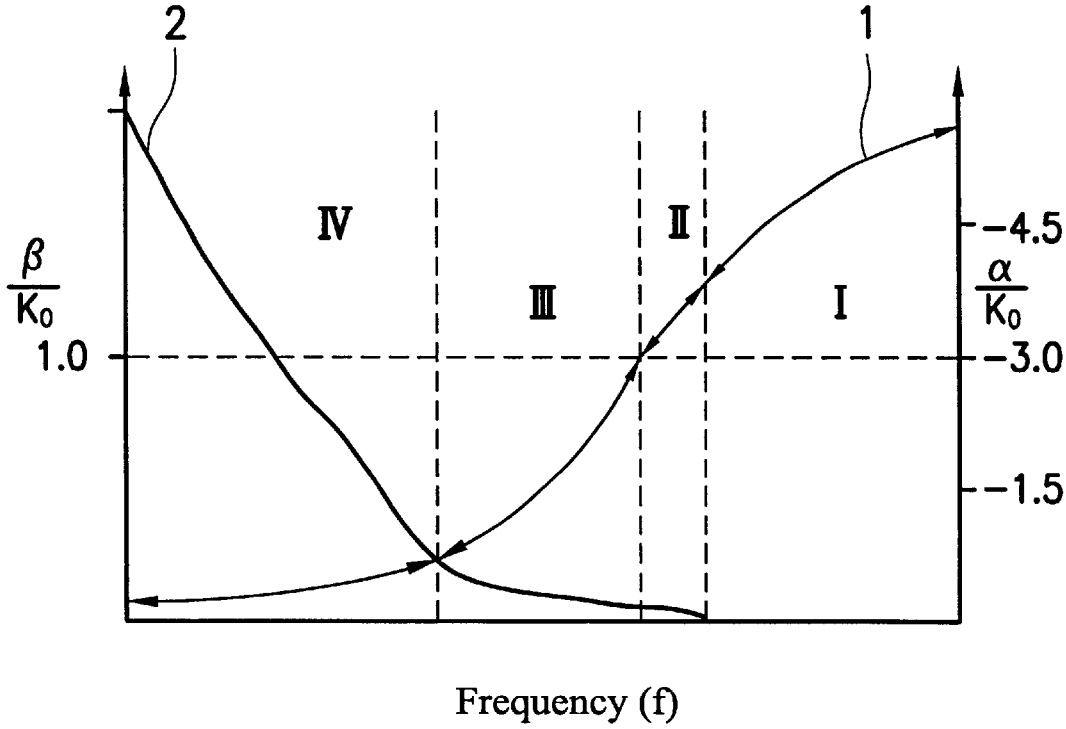
Fig. 2 ( PRIOR ART )
FIG. 2 (PRIOR ART) is a graph showing the relation between the normalized phase constant /Ko and the normalized attenuation constant /Ko for higher order modes with respect to the frequency f in the conventional microstrip line.
Figure 3:
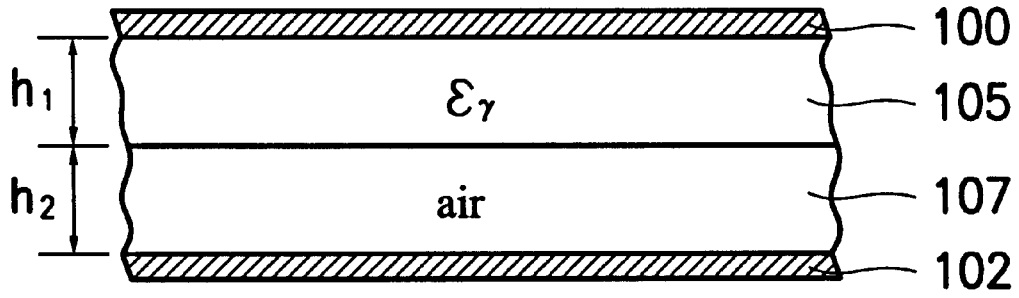
FIG. 3 is a diagram showing the analysis model of the microstrip leaky-wave antenna with a stuffed substrate in accordance with the first embodiment of the present invention.

FIG. 3 is a diagram showing the structure of the stuffed substrate having a cavity therein in this embodiment. In FIG. 3, conductive plate 100 and conductive plate 102 are respectively located on two surfaces of the substrate that is constituted by dielectric layer 105 and air layer 107. In addition, conductive layer 100 represents microstrip lines used as an antenna body. The heights of dielectric layer 105 and air layer 107 are denoted by h1 and h2, respectively. It is noticed that the structure shown in FIG. 3 is only an analysis model and is not equivalent to the practical case of the microstrip leaky-wave antenna. For example, there should be a prop element for separating dielectric layer 105 from conductive plate 102, and conductive plate 100 is not totally the same as microstrip lines in shape. However, in view of the analysis model, we can clearly observe the varying trend of the effective dielectric constant.

Figure 4:
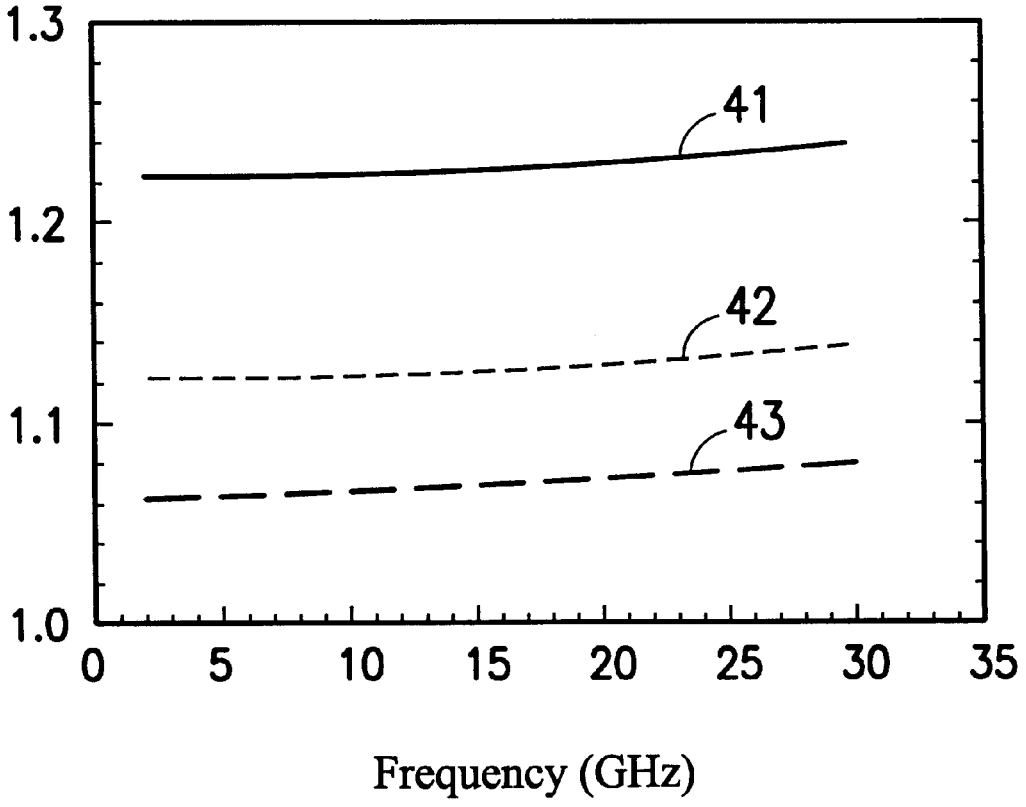
FIG. 4 is a diagram showing the effective dielectric constant with respect to different thickness of the dielectric layer and the air layer in FIG. 3.

FIG. 4 is a diagram showing the relationship between the dielectric constant and the operating frequency under various conditions of h1 and h2 according to the analysis model shown in FIG. 3, where dielectric layer 105 is supposed to be uniform and its dielectric constant is 2.2. The condition corresponding to characteristic curve 41 is h1=20 mils and h2=40 mils. The condition corresponding to characteristic curve 42 is h1=20 mils and h2=80 mils. The condition corresponding to characteristic curve 43 is h1=20 mils and h2=160 mils. Obviously, the effective dielectric constant $\epsilon_{eff}$ will vary with the ratio of the thickness of dielectric layer 105 and air layer 107. If the thickness of the air layer 107 increases, the effective dielectric constant $\epsilon_{eff}$ will approach 1. The method of stuffing the substrate with air adopted by this embodiment can certainly decrease the effective dielectric constant of the substrate.

Figure 5:
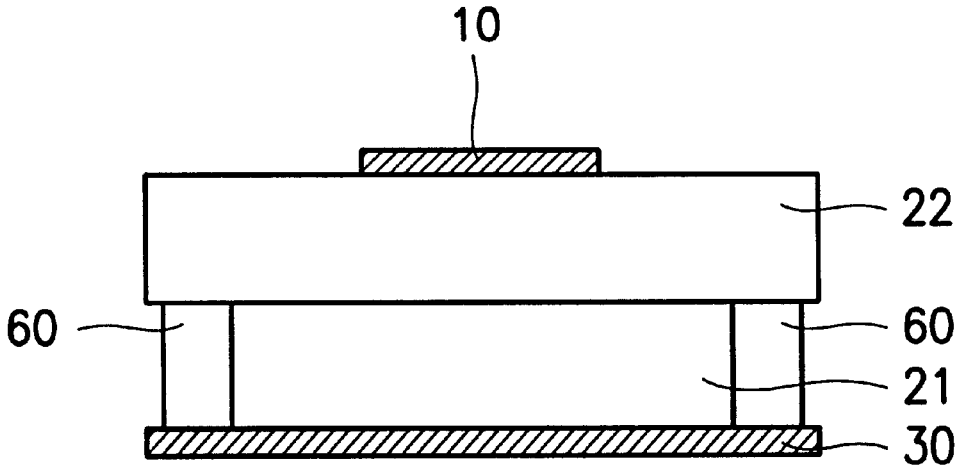
FIG. 5 is a sectional view of a first example of the microstrip leaky-wave antenna in accordance with the first embodiment of the present invention.

FIG. 5 is a perspective view of the structure of the microstrip leaky-wave antenna in this embodiment. The substrate structure is sandwiched in between a microstrip 10 and a grounded metal plate 30 and includes a dielectric layer 22 and a prop element 60 located between dielectric layer 22 and the grounded metal plate 30. In addition, there is a cavity region 21 under the microstrip 10. The cavity region is usually filled up with air, but it is noticed that this feature is not used to limit the present invention. Since the substrate structure between the microstrip 10 and the grounded metal plate 30 is constituted by the dielectric layer 22 and the cavity region 21, the resulted effective dielectric constant is lower than the original effective dielectric constant of the dielectric layer 22 according to the analysis model described above. In addition, if the thickness of the cavity region 21 increases, the effective dielectric constant will approach 1. Therefore, the bandwidth of the microstrip leaky-wave antenna is also enlarged.

Figure 6:
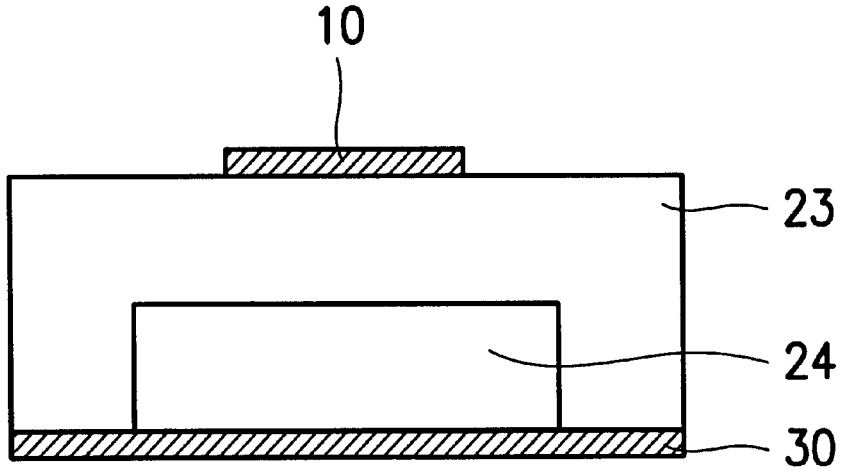
FIG. 6 is a sectional view of a second example of the microstrip leaky-wave antenna in accordance with the first embodiment of the present invention.

FIG. 6 is a perspective view of another structure of the microstrip leaky-wave antenna in this embodiment. As shown in FIG. 6, the substrate structure is constituted by a dielectric layer 23, which has a cavity region 24 on the side surface contiguous to the grounded metal plate 30 and exactly under the microstrip 10. Therefore, the portion of the substrate structure between the microstrip 10 and the grounded metal plate 30 includes the dielectric layer 23 and the cavity region 24 therein. Accordingly, its effective dielectric constant is also lower than the original effective dielectric constant of the dielectric layer 23. In addition, if the thickness of the cavity region 24 increases, the effective dielectric constant will approach 1. Therefore, the bandwidth of the microstrip leaky-wave antenna is also enlarged.

Figure 7:
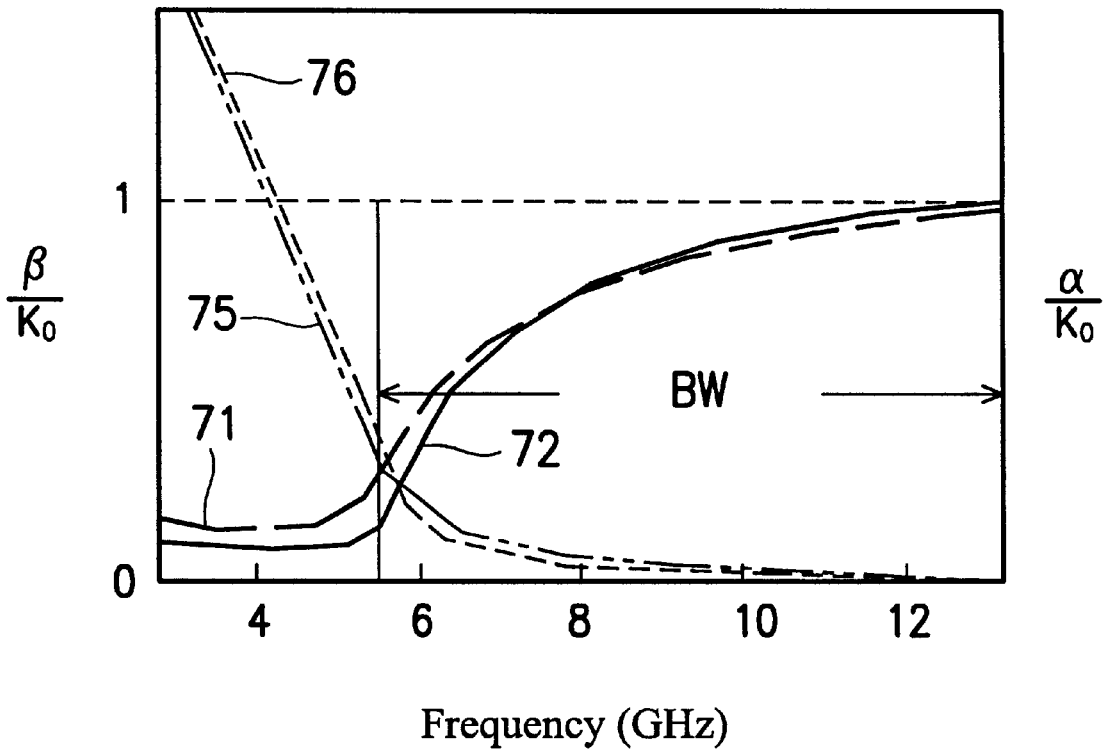
FIG. 7 is a graph showing the relation between the normalized phase constant /Ko and the normalized attenuation constant /Ko for the first higher order mode with respect to the frequency f in the first embodiment of the present invention.

FIG. 7 represents a diagram showing the curves of the normalized phase constant $\beta/k_0$ and the normalized attenuation constant $\alpha/k_0$ for the higher order modes in view of the frequency f in this embodiment. Suppose that the thickness of the dielectric layer in the substrate is 20 mils and its original dielectric constant is 2.2. FIG. 7 illustrates two conditions, in which the thickness of the air layer is different. The characteristic curves 71 and 75 represent the normalized phase constant $\beta/k_0$ and the normalized attenuation constant $\alpha/k_0$ under the condition that the thickness of the air layer is 40 mils. The characteristic curves 72 and 76 represent the normalized phase constant $\beta/k_0$ and the normalized attenuation constant $\alpha/k_0$ under the condition that the thickness of the air layer is 80 mils. According to FIG. 7, if the space wave region for the higher order modes (that is, $\alpha/k_0<\beta/k_0<1$) is regarded to be bandwidth BW, the bandwidth is about 7 GHz.

It is noticed that, in this embodiment, the thickness of the dielectric layer must decrease when the operating frequency raises. Otherwise, the dielectric constant can increase as the surface wave propagation constant of the substrate increases. In addition, the structures of the microstrip leaky-wave antennas shown in FIG.5 and FIG. 6 are not used to limit the present invention. For example, the cavity region is optionally connected with the grounded metal plate. In other words, the object of the present invention also can be achieved by placing the cavity region at the center of the substrate.

Second Embodiment

The scheme used in this embodiment is to reverse the relative locations of the microstrip and the below dielectric layer wholly in the microstrip leaky-wave antennas disclosed in the first embodiment. More specifically, the microstrip line is located within the cavity region. Since the microstrip line is spaced from the grounded metal plate by the air, the effective dielectric constant is almost equal 1.

Figure 8:
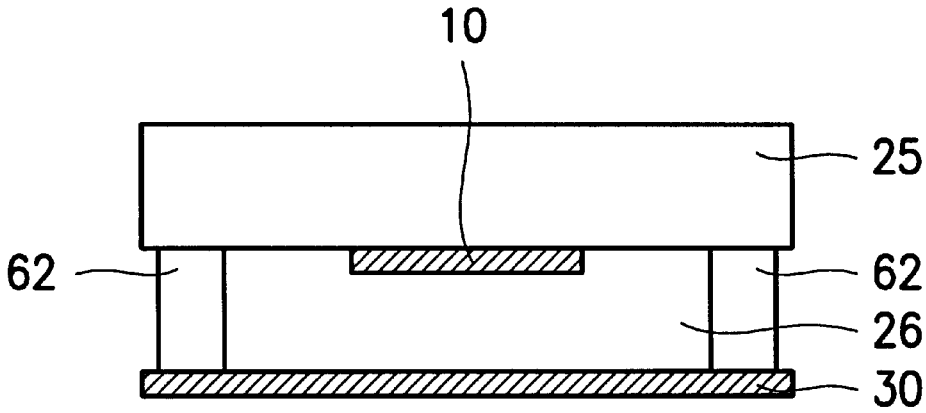
FIG. 8 is a sectional view of a first example of the microstrip leaky-wave antenna in accordance with the second embodiment of the present invention.

FIG. 8 is a perspective view of the microstrip leaky-wave antenna structure in this embodiment. As shown in FIG. 8, the microstrip line 10 is located on the lower side of the dielectric layer 25. In addition, prop elements 62 are used to separate the dielectric layer 25 and the grounded metal plate 30 for defining a cavity region 26 between them. In other words, the microstrip line 10 is located in the cavity region 26 and there is no dielectric material between the microstrip line 10 and the grounded metal plate 30. Therefore, the effective dielectric constant is very close to 1. It causes the antenna bandwidth to be enlarged.

Figure 9:
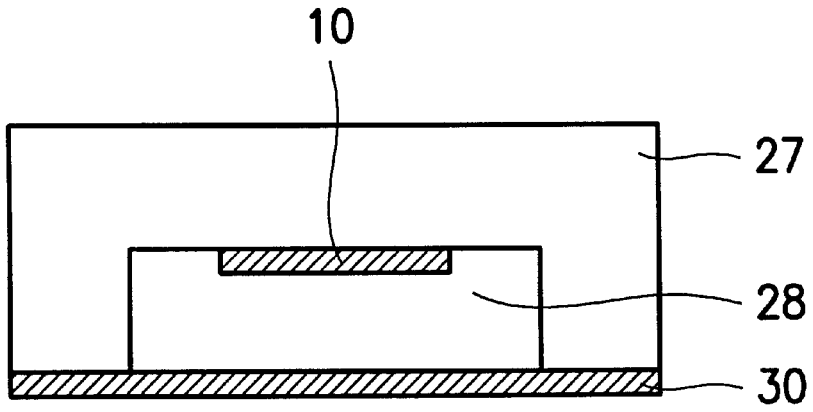
FIG. 9 is a sectional view of a second example of the microstrip leaky-wave antenna in accordance with the second embodiment of the present invention.

FIG. 9 is a perspective view of another microstrip leaky-wave antenna structure in this embodiment, which is very similar to that shown in FIG. 8. As shown in FIG. 9, a dielectric layer 27 includes a cavity region 28 and the microstrip line 10 is located at the upper portion of the cavity region 28. In addition, the side surface of the dielectric layer 27 that embraces the cavity region 28 is connected to the grounded metal plate 30. In other words, the microstrip line 10 is located in the cavity region 28 and there is no dielectric material between the microstrip line 10 and the grounded metal plate 30. Therefore, the effective dielectric constant is very close to 1. It causes the antenna bandwidth to be enlarged.

Figure 10:
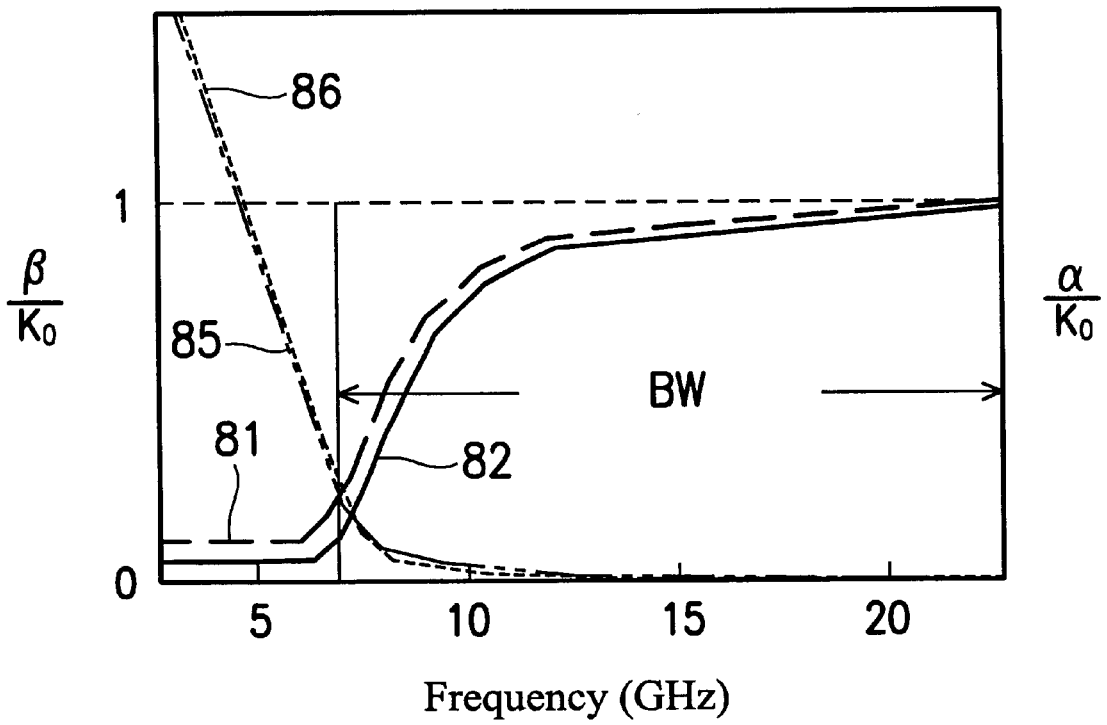
FIG. 10 is a graph showing the relation between the normalized phase constant /Ko and the normalized attenuation constant /Ko for the first higher order mode with respect to the frequency f in the second embodiment of the present invention.

FIG. 10 represents a diagram showing the curves of the normalized phase constant $\beta/k_0$ and the normalized attenuation constant $\alpha/k_0$ for the higher order modes in view of the frequency f in this embodiment. Suppose that the thickness of the dielectric layer over the substrate is 20 mils and its original dielectric constant is 2.2. Similar to the first embodiment, FIG. 10 illustrates two conditions, in which the thickness of the air layer is different. The characteristic curves 81 and 85 represent the normalized phase constant $\beta/k_0$ and the normalized attenuation constant $\alpha/k_0$ under the condition that the thickness of the air layer is 40 mils. The characteristic curves 82 and 86 represent the normalized phase constant $\beta/k_0$ and the normalized attenuation constant $\alpha/k_0$ under the condition that the thickness of the air layer is 20 mils. Apparently, if the space wave region for the higher order modes (that is, $(\alpha/k_0<\beta/k_0<1)$ is regarded to be bandwidth BW, the bandwidth is about 15 GHz.

Third Embodiment

In the prior art and the first/second embodiments, there is a ground metal plate opposite to the microstrip line. In this embodiment, however, this grounded metal plate is omitted, which also can achieve the same object of increasing the bandwidth.

Figure 11:
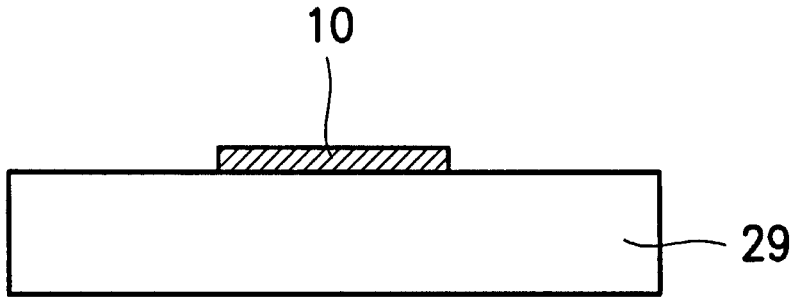
FIG. 11 is a sectional view of the microstrip leaky-wave antenna in accordance with the third embodiment of the present invention.

FIG. 11 is a perspective view of the microstrip leaky-wave antenna structure in this embodiment. As shown in FIG. 11, the antenna structure disclosed in this embodiment is simpler than those disclosed in the first embodiment and the second embodiment. In this embodiment, the antenna is constituted by placing a microstrip line 10 on a dielectric layer serving as the substrate. There is no grounded metal plate in this antenna structure. For the microstrip line 10 without a corresponding grounded metal plate, the surface wave on the dielectric layer 29 can bounce under the microstrip line 10 to generate leaky waves in higher order modes. Since such antennas without grounded metal plates do not have canceling effect in horizontal directions, they can be used as endfire high-gain antennas.

Figure 12:
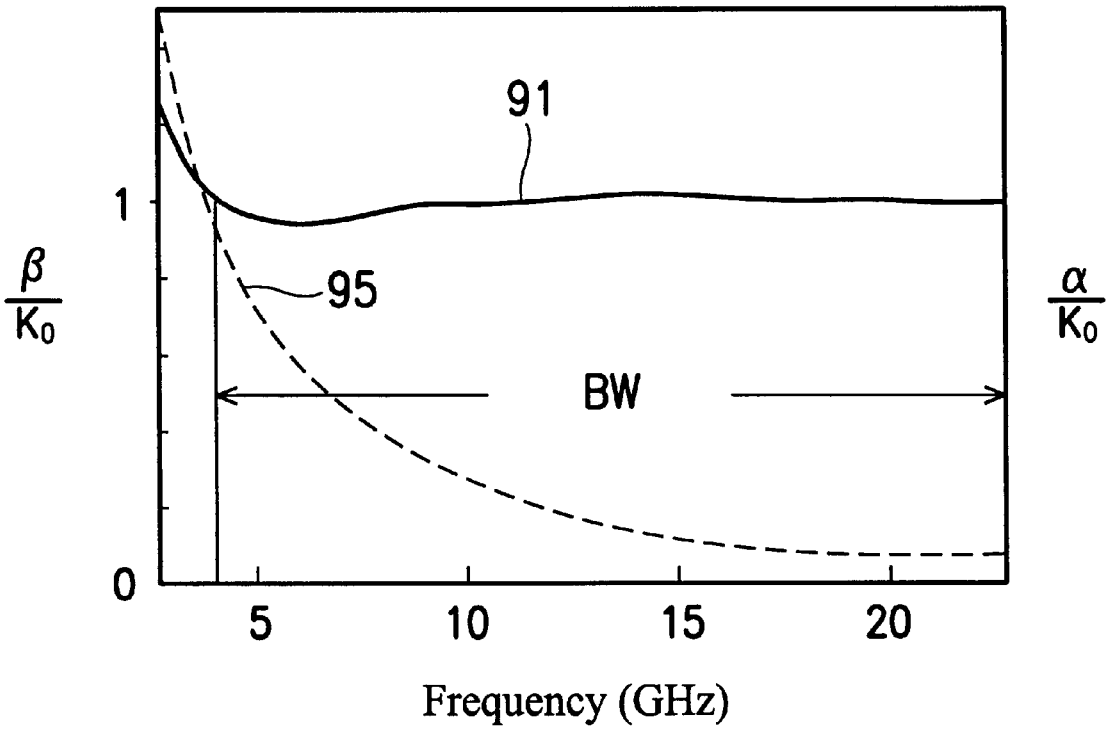
FIG. 12 is a graph showing the relation between the normalized phase constant /Ko and the normalized attenuation constant /Ko for the higher order mode with respect to the frequency f in the third embodiment of the present invention.

FIG. 12 represents a diagram showing the curves of the normalized phase constant $\beta/k_0$ and the normalized attenuation constant $\alpha/k_0$ for the first higher order mode in view of the frequency f in this embodiment. Suppose that the width W of the microstrip line is 20 mm, the thickness h of the dielectric layer is 20 mils and the dielectric constant $\epsilon_r$ is 2.2. In FIG. 12, the characteristic curve 91 corresponds to the normalized phase constant $\beta/k_0$ and the characteristic curve 95 corresponds to the normalized attenuation constant $\alpha/k_0$. Apparently, the corresponding bandwidth BW is quite wide. More importantly, the normalized phase constant $\beta/k_0$ is almost a constant in various frequencies. According to equation (3), the direction of the emitted major lobe (denoted by $\theta$) depends on the normalized phase constant $\beta/k_0$ in different operating frequencies. Therefore, if the parameter is almost a constant, it means that the direction of the major lobe of the leaky-wave antenna is insensitive with respect to the operating frequency, which can achieve the object of the present invention.

In fact, the structure of the microstrip leaky-wave antenna disclosed in FIG. 11 of this embodiment can be further simplified. That is, the dielectric layer under the microstrip line can be deleted. In this case, the microstrip line is surrounded by the air, which also can achieve the same object of the present invention. The feeding system for this case can convey energy from an end of the microstrip line.

While the invention has been described by way of example and in terms of the preferred embodiment, it is to be understood that the invention is not limited to the disclosed embodiments. On the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A wideband microstrip leaky-wave antenna, comprising:

a substrate constituted by at least one dielectric layer and having a first surface, a second surface opposite to the first surface, and a cavity located on the second surface;

a microstrip line having a width less than that of the cavity and is made of conductive material and located on the first surface of the substrate corresponding to a location of the cavity, for emitting leaky waves; and a conductive plate made of conductive material and located on the second surface of the substrate opposite to the first surface wherein the cavity of the substrate is contiguous to the conductive plate.

2. The wideband microstrip leaky-wave antenna as recited in claim 1, wherein the microstrip line is located exactly over the cavity of the substrate.

3. The wideband microstrip leaky-wave antenna as recited in claim 1, wherein the microstrip line is located exactly over the cavity of the substrate.

4. The wideband microstrip leaky-wave antenna as recited in claim 1, wherein the substrate further comprises:

at least one prop element located between the dielectric layer and the conductive plate, for defining the cavity in a vacant space between the dielectric layer and the conductive plate.

5. The wideband microstrip leaky-wave antenna as recited in claim 4, wherein the microstrip line is exactly located over the cavity of the substrate.

6. A wideband microstrip leaky-wave antenna, comprising:

a substrate constituted by at least one dielectric layer and having a cavity therein;

a microstrip line having a width less than that of the cavity and is made of conductive material and located in the cavity of the substrate, for emitting leaky waves;

a conductive plate made of conductive material and located on a surface of the substrate, the dielectric layer of the substrate being excluded from a space between the conductive plate and the microstrip line and an effective dielectric constant for the antenna that approaches 1.

7. The wideband microstrip leaky-wave antenna as recited in claim 6, wherein the cavity of the substrate is contiguous to the conductive plate.

8. The wideband microstrip leaky-wave antenna as recited in claim 6, wherein the substrate further comprises:

at least one prop element located between the dielectric layer and the conductive plate, for defining the cavity in a vacant space between the dielectric layer and the conductive plate.

9. A wideband microstrip leaky-wave antenna, comprising:

a substrate constituted by at least one dielectric layer;

a microstrip line made of conductive material and located on a first surface of the substrate, for emitting leaky waves, wherein on a second surface of the substrate opposite the first surface there is no conductive plate corresponding to the microstrip line and a normalized phase constant of the antenna that is generally constant in frequency response.

10. A method for a wideband microstrip leaky-wave antenna, comprising the steps of:

providing a substrate constituted by at least one dielectric layer;

providing a cavity in the substrate;

providing a microstrip line made of conductive material and surrounded by air, wherein the microstrip line has a width less than that of the cavity;

locating the microstrip line in the cavity;

feeding an end of the microstrip line into a current for emitting leaky waves;

providing a conductive plate made of conductive material;

locating the conductive plate on a surface of the substrate;

excluding the dielectric layer of the substrate from a space between the conductive plate and the microstrip line; and causing an effective dielectric constant of the antenna to approach 1.

11. The method of claim 10 further comprising the step of:

providing at least one prop element located between the dielectric layer and the conductive plate for defining the cavity in a vacant space between the dielectric layer and the conductive plate.

* * * * *